US006411260B1

(12) United States Patent
Weglarz et al.

(10) Patent No.: US 6,411,260 B1
(45) Date of Patent: Jun. 25, 2002

(54) TRIPLE FREQUENCY, SPLIT MONOPOLE, EMERGENCY LOCATOR TRANSMITTER ANTENNA

(75) Inventors: Victor M. Weglarz, Oakville; Carl F. Weisser, Aurora; Jacob S. Cohen, Bramalea, all of (CA)

(73) Assignee: AlliedSignal Inc., Morristown, NJ (US)

( * ) Notice: Subject to any disclaimer, the term of this patent is extended or adjusted under 35 U.S.C. 154(b) by 1163 days.

(21) Appl. No.: 08/847,804

(22) Filed: Apr. 28, 1997

Related U.S. Application Data

(63) Continuation of application No. 08/704,294, filed on Aug. 28, 1996, now abandoned, which is a continuation of application No. 08/292,535, filed on Aug. 18, 1994, now abandoned.

(51) Int. Cl.[7] ..... H01Q 5/01; H01Q 9/32
(52) U.S. Cl. ..... 343/722
(58) Field of Search ..... 343/709, 722, 343/749; H01Q 5/00, 5/01, 9/04, 9/32

(56) References Cited

U.S. PATENT DOCUMENTS 2,282,292 A * 5/1942 Amy et al. ..... 343/722
3,176,298 A * 3/1965 Nettles ..... 343/722
3,566,235 A 2/1971 Rose et al. ..... 343/705
3,587,103 A 6/1971 Lawrie et al. ..... 343/709
3,653,053 A 3/1972 St. Vraine ..... 343/745
4,145,693 A * 3/1979 Fenwick ..... 343/722
4,962,488 A * 10/1990 Dell-Imagine et al. ..... 343/709
5,258,765 A * 11/1993 Dorrie et al. ..... 343/722

* cited by examiner

*Primary Examiner*—Michael C. Wimer
(74) *Attorney, Agent, or Firm*—Larry J. Palguta

(57) ABSTRACT

A split monopole antenna that provides for simultaneous transmission of 121.5, 243 and 406 MHz emergency signals using a simple, lightweight structure that can be stowed in an aircraft in a compact manner during non-deployment, and after deployment enables the beacon to float in water in an upright orientation. The monopole antenna comprises three radiating elements. The first radiating element is electrically coupled to a transmitting unit and radiates a 406.025 MHz signal; the second radiating element is electrically coupled to the first radiating element by way of a first band rejection filter and both elements radiate at 243 MHz; and the third radiating element is electrically coupled to the second radiating element by way of a second band rejection filter and all three elements radiate at 121.5 MHz.

18 Claims, 6 Drawing Sheets

TRIPLE FREQUENCY, SPLIT MONOPOLE, EMERGENCY LOCATOR TRANSMITTER ANTENNA

This is a continuation, of application Ser. No. 08/704,294 filed on Aug. 28, 1996, abandoned, which is a Continuation of Ser. No. 08/292,535 filed on Aug. 18, 1994 abandoned.

FIELD OF THE INVENTION

The present invention relates to the field of antennae for transmitting radiation, and more particularly, to a split monopole antenna for application in the triple frequencies of an emergency locator transmitter.

BACKGROUND OF THE INVENTION

United States and Canadian law requires the use of emergency locating transmitters (ELTs) on all small aircraft traveling more than 25 miles from an airport and emergency position indicating radio beacons (EPIRBs) on certain classes of marine vessels. ELTs and EPIRBs are essentially the same device which transmit an audio tone on legislatively assigned frequencies of 121.5 MHz and 243 MHz indicating that a distress incident has occurred. The audio tone generated by these devices is provided by a distress modulation signal legislatively assigned to have a 2 to 4 Hz cyclic waveform wherein each cycle has a downward sweep of at least 700 Hz between 300 and 1600 Hz. The distress waveform demodulated in a conventional AM receiver provides a siren-like audio tone that is recognized by distress band observers. Search and rescue personnel, such as the Civil Air Patrol, search for the location of the distress transmission and initiate rescue operations. The distress transmission, however, contains no information to determine the identity/owner of the distress beacon. Knowledge of the identity/owner would, for example, enable the rescue coordinator to assign priorities and resources in a multiple emergency situation so that the emergencies that are critical from a time survival relationship are attended to early.

The introduction of a third emergency channel, the 406 MHz, by COSPAS-SARSAT, an international organization, during the early 1980s has corrected this system limitation. The 406 MHz emergency signal is a high energy pulse onto which owner/operator unique information is modulated. The 406 MHz has, in addition, improved frequency stability.

Satellite-aided search and rescue systems have been developed to augment existing search and rescue force capabilities to detect and locate ELT/EPIRB signal sources. Satellites aid the distress monitoring coverage by their high orbital altitude. The orbiting satellites respond to low level 121.5 HMz distress signals as well as high level 406 MHz data signals in a form specified by COSPAS-SARSAT and in the United States by the Federal Communications Commission. The 406 MHz information bursts contain information concerning user identification, country or origin and the category of the emergency beacon (e.g. maritime or aviation). The 406 MHz information is either processed on board the satellite or relayed to ground based instrumentation for processing. The continuous low level 121.5 MHz signal enables search and rescue personnel in close proximity to the emergency site to determine a final location to within a radius of approximately one kilometer.

Existing ELT/EPIRB products are mostly of the 121.5/243 MHz type. Other existing ELT/EPIRB radiate at either 406 MHz only, or at 121.5 and 406 MHz. Still other distress beacons with all three frequencies may be available within the marine sector (i.e. EPIRBs). The marine application tends not to place restrictive requirements on weight and size. Weight and size restrictions, however, are common for ELTs for use on aircraft. U.S. Pat. No. 3,653,053 to St. Vraine et al., for example, discloses a multi-frequency antenna, but is complex and its large size and high weight make it impractical to implement on a small "survival" ELT.

SUMMARY OF THE INVENTION

The present invention provides a split monopole antenna that provides for simultaneous transmission of 121.5, 243 and 406 MHz emergency signals using a simple, lightweight structure. The invention provides a design that allows the antenna to be stowed in an aircraft as part of the ELT in a compact manner during non-deployment and after deployment allows the ELT to float in water in an upright orientation. The present invention is meant to replace existing certified 121.5/243 MHz ELTs; the structural requirements of the present invention are, therefore, dictated by the symmetrical, small radius, lightweight and short length configuration of the simple monopole antenna of the prior art. Although the prior art mechanical restrictions dictate a similar structure, the electrical properties require that the present invention have significantly improved efficiency at 121.5 and 243 MHz over the prior art, and a highly efficient and well defined radiation pattern at 406 MHz In one embodiment of the present invention, the monopole antenna comprises three radiating elements. A first radiating element is electrically coupled to a transmitting unit and radiates a 406.025 MHz signal; the second radiating element is electrically coupled to the first radiating element by way of a first band rejection filter and both elements radiate at 243 MFz; and the third radiating element is electrically coupled to the second radiating element by way of a second band rejection filter and all three elements radiate at 121.5 MHz. The effective length of each radiating elements at 121.5 and 243 MHz is approximately one quarter wavelength. The effective length of the radiating element at 406 MHz is slightly shorter than one quarter wavelength. Accordingly, each radiating group is physically shorter at progressive higher frequencies.

In an alternate embodiment of the invention, the monopole antenna comprises a first radiating element electrically coupled to a transmitting unit that radiates at 406 MHz and a single piece radiating rod that defines a second and third radiating element defined by the placement of a second band rejection filter. The first radiating element connects to the rod by way of a first band rejection filter.

It is therefore an object of this invention to provide a triple frequency ELT that will occupy the same fit and form as an existing certified 121.5/243 MHz ELT by survivors of downed aircraft.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the elements and combinations particularly pointed out in the appended claims.

BRIEF DESCRIPTION OF THE DRAWINGS

The above and other objects and advantages of this invention will be apparent on consideration of the following detailed description, taken in conjunction with the accompanying drawings, in which like reference characters refer to like parts throughout, and in which.

DETAILED DESCRIPTION OF THE INVENTION

The following detailed description, which describes only the preferred embodiments of the invention, is understood only to be an illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

Figure 1:
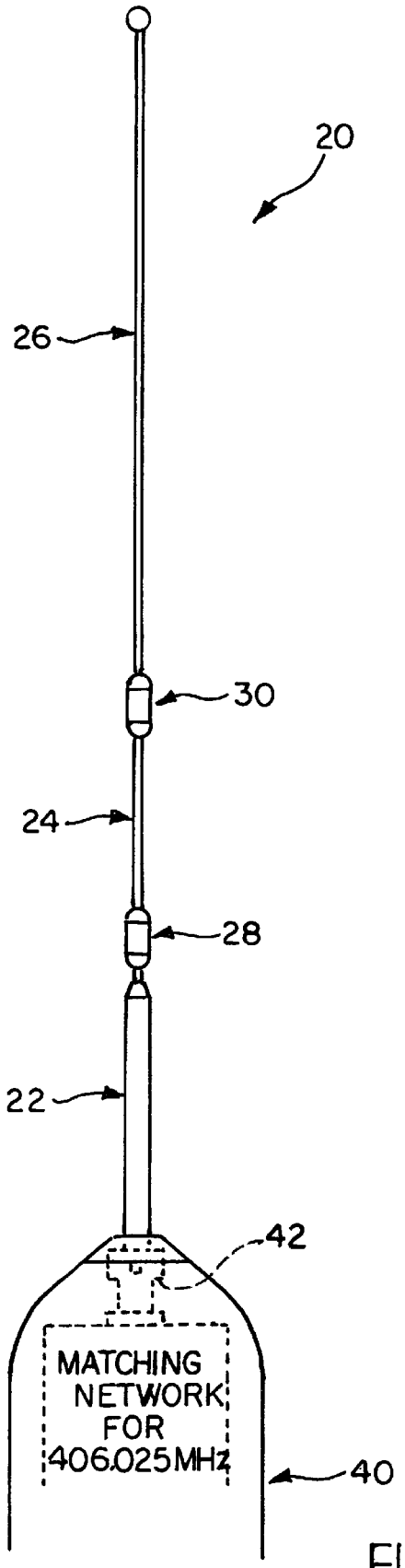
FIG. 1 illustrates one embodiment of the present invention.
Figure 2:
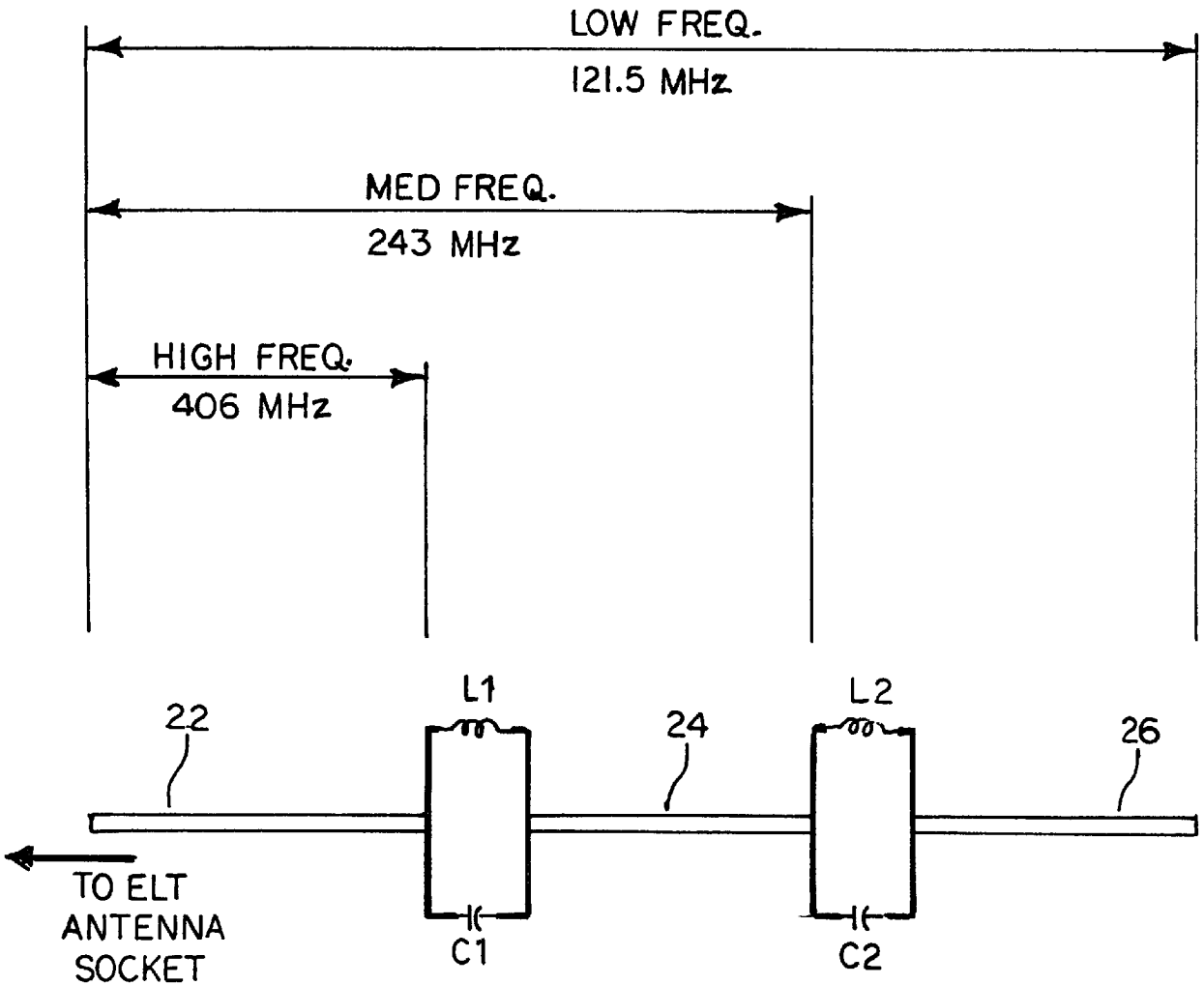
FIG. 2 is an electrical circuit equivalent of the present invention.

FIG. 1 depicts one preferred embodiment of the present invention, a monopole antenna 20 comprising three radiating elements 22, 24 and 26. Elements 22, 24 and 26 radiate a 121.5 MHz signal; elements 22 and 24 radiate a 243 MHz signal and element 22 radiates a 406 MHz signal. The radiation efficiency at 121.5 and 243 MHz dictates an effective length at each frequency of approximately one quarter wave length. The radiation efficiency and radiation pattern at 406 MHz required by legislation is obtained by an antenna slightly shorter than one quarter wave length at 406 MHz. Accordingly, the combined radiating elements are physically shorter at progressively higher frequencies. Element 26 is separated from element 24 by a trap 30, and element 24 is separated from element 22 by a trap 28. Each trap comprises a capacitor/inductor parallel network positioned at selected distances on the monopole antenna 20. A trap is a form of band-rejection filter designed for blocking energy at one frequency while allowing energy to pass at all other frequencies. By selecting the inductor-capacitor ratio, the tuned networks are only electrically significant at either the 406 MHz or the 243 MHz frequencies. The elements are resonated at the desired operating frequency by tuning the inductor. FIG. 2 illustrates the electrical equivalent of antenna 20.

Figure 3:
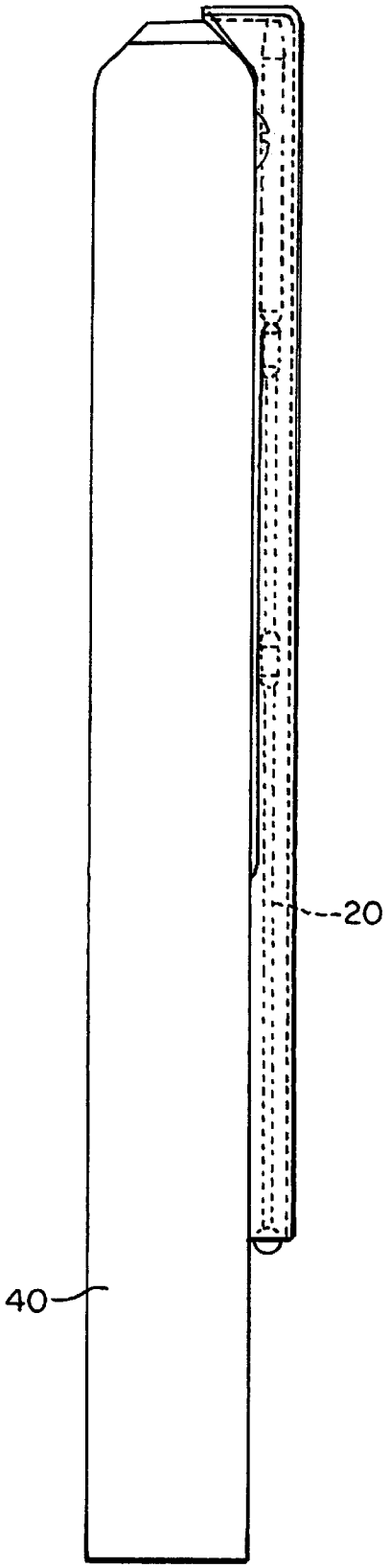
FIG. 3 illustrates one embodiment of the invention in conjunction with a beacon in a non-deployed state.
Figure 4:
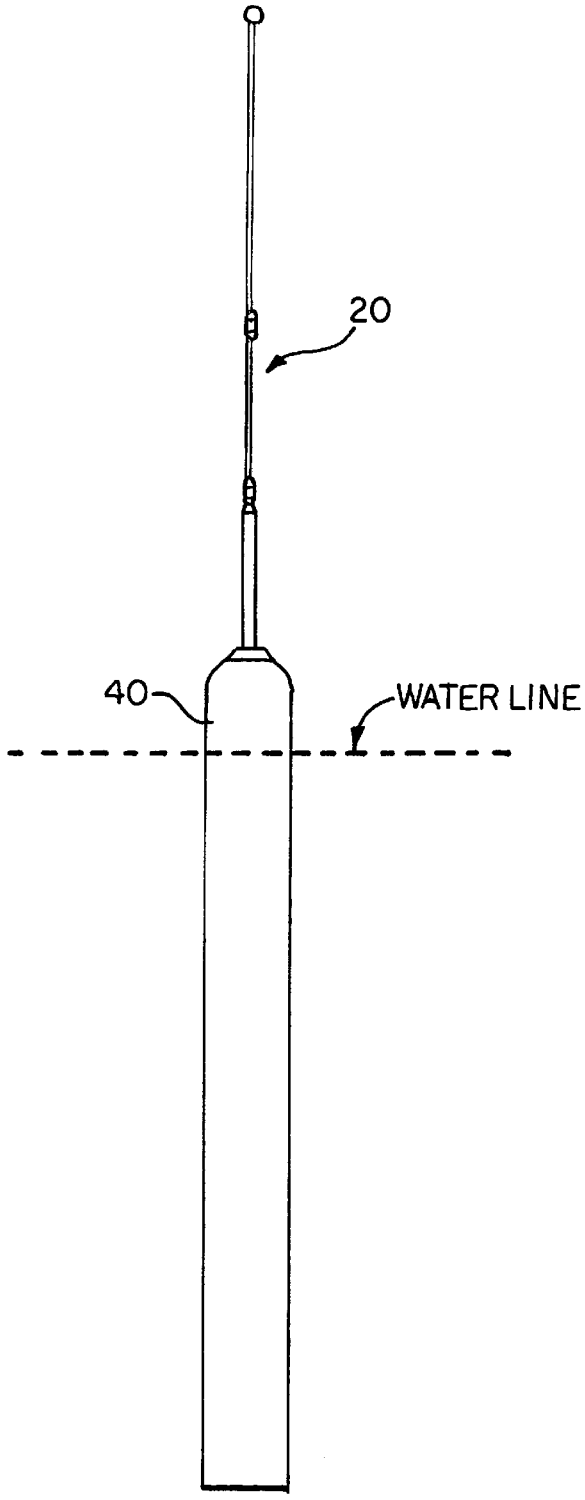
FIG. 4 illustrates one embodiment of the invention in conjunction with a beacon in a deployed state.

The purpose of the split monopole antenna of the present invention is to allow simultaneous transmission of 121.5, 243 and 406 MHz electromagnetic signals using a simple, lightweight structure. In one application, antenna 20 can be stowed on the side of beacon 40 during non-deployment, shown in FIG. 3, and after deployment, the beacon and antenna will float in water in an upright orientation as shown in FIG. 4. The deployment of the antenna 20 to its upright position after deployment in water is automatic as disclosed in U.S. Pat. No. 3,587,103 to Lawrie which is incorporated by reference herein.

Referring again to FIG. 1, each radiating element is a separate component, connected via traps to its adjacent radiating element(s). When antenna 20 is in the upright position and seated in the antenna socket 42, radiating element 22 is matched to 50 Ω at 406.025 MHz by a network mounted within the housing of a beacon 40. Element 22 is preferably made of silver plated aluminum and has a physical length of 13.7 cm measured from the cross beam where element 22 sits within beacon 40 to the tip where a 4–40 thread is cut.

Figure 5:
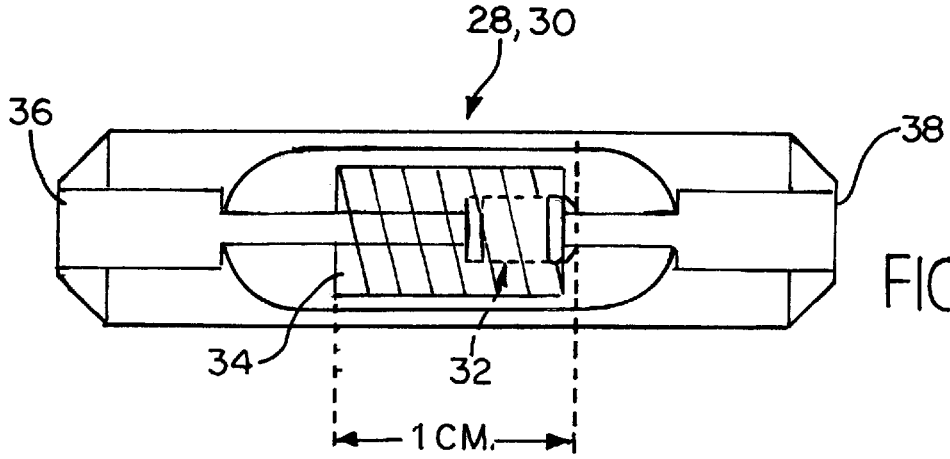
FIG. 5 illustrates one embodiment of a band rejection filter
Figure 6:
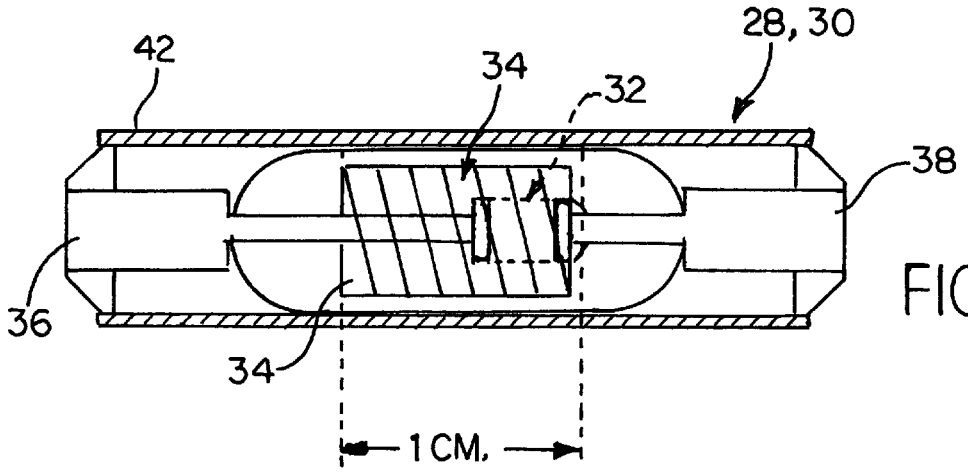
FIG. 6 illustrates an alternate embodiment of the band rejection filter of FIG. 5.

Element 22 is connected to element 24 by way of trap 28. FIG. 5 illustrates the components of each trap 28 and 30 which comprise a 2.2 pF chip capacitor 32 in parallel with an inductor 34. The capacitor is mounted inside the inductor coil and both ends of the inductor-capacitor network are soldered to tapped (4–40) brass inserts 36 and 38 to couple adjacent radiating elements. The entire trap is encased in a plastic body for protection. The length of the brass inserts must be taken into account when considering the overall length of the elements. The preferred inserts are 1.0 cm. long, and the tip of element 22 threads into the insert by 0.5 cm, and therefore, the insert adds 0.5 cm. to the length of element 22, therefore, giving element 22 an overall length of 14.2 cm. A 2.2 pF chip capacitor is preferably used in all the traps, and the inductor coil is tuned accordingly. All coil data can be found in TABLE 1. After tuning, the traps are preferably protected with heat-shrink tubing. Alternatively, the traps may be encased in a stainless steel tube 42 for added physical protection, as shown in FIG. 6. In operation, element 22 radiates at 406.025 MHz, and the upper two elements 24 and 26 are isolated by trap 28.

Again referring to FIG. 1, element 24 is made from ⅛ in. solid brass rod 11.4 cm long and plated with silver. Both ends are threaded with 4–40 threads by 0.5 cm. long. Element 24 electrically couples with element 22 by way of trap 28, and electrically couples with element 26 by way of trap 30. Accordingly, the brass inserts from both traps must also be accounted for which would make the overall length of element 24 to be 12.4 cm. At 243 MHz, trap 28 provides minimal isolation and therefore this signal radiates from elements 22 and 24. Trap 30 effectively isolates element 26 at 243 MHz.

Element 26, is 23.8 cm. long (an overall length of 24.3 cm. when coupled to brass insert of trap 30) and is made of the same material as element 24, but has threads at one end only. At 121.5 MHz traps 28 and 30 do not provide isolation and therefore all three elements radiate this signal.

Figure 7:
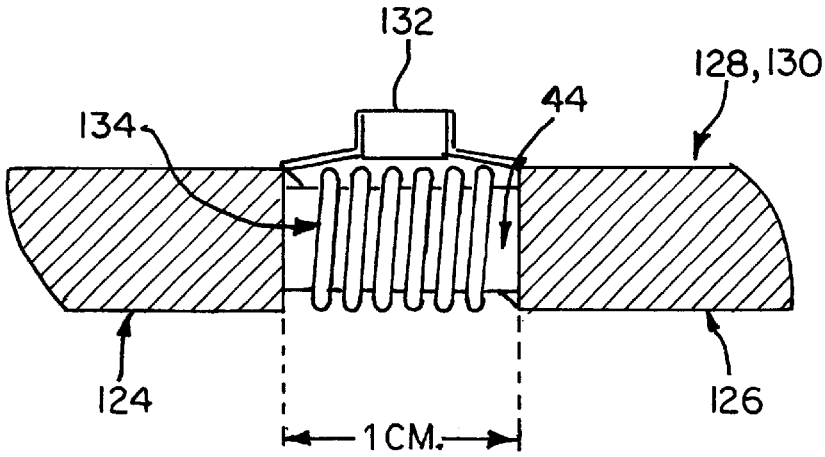
FIG. 7 illustrates the preferred embodiment of the band rejection filter.
Figure 8:
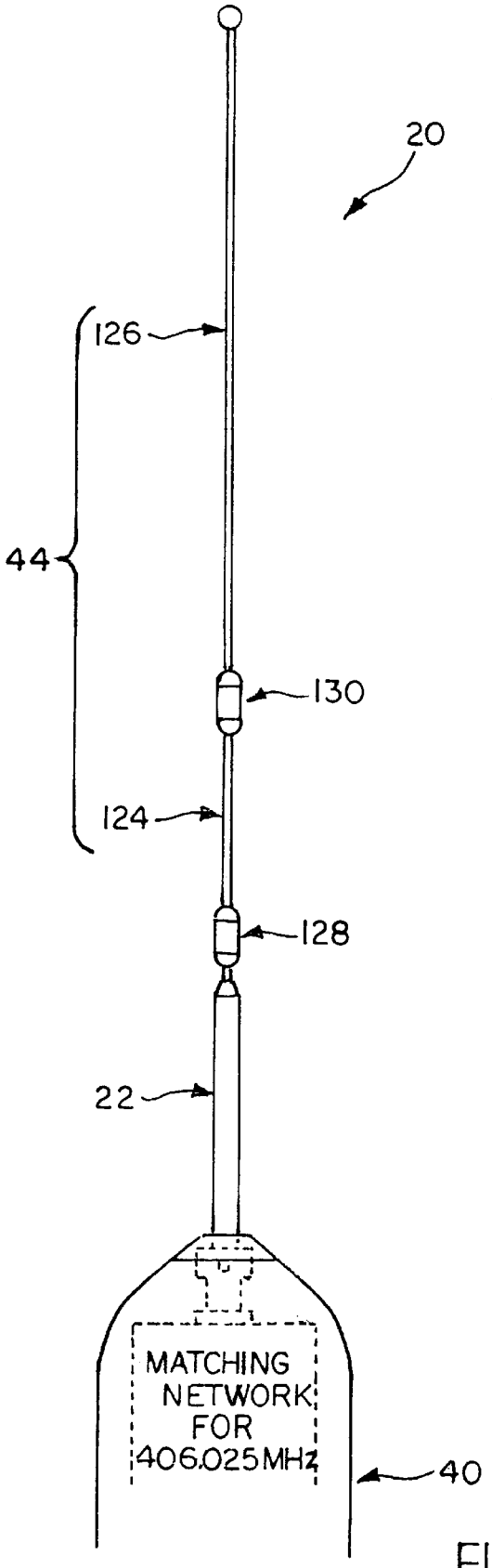
FIG. 8 illustrates the preferred embodiment of the present invention.

In an alternate preferred embodiment, shown in FIG. 8, antenna 20 comprises radiating element 22 and radiating elements 124 and 126 made from a single tapered insulating rod 44 that is copper coated and then silver plated. Preferably, rod 44 is made of fiberglass. Radiating elements 124 and 126 are defined by the placement of traps 128 and 130. Radiating element 124 measures 12 cm. long (its overall length also), and radiating element 126 measures 24.1 cm. long (its overall length also). At the locations of the traps on rod 44, the diameter is reduced and the plating is removed, as shown in FIG. 7. The inductor coils 134 are wound on these voids and soldered to the adjacent radiating elements. The capacitors 132 are placed to the side of the coils and the leads soldered to adjacent elements. Preferably, a low profile capacitor is used to minimize the cross-sectional area and provide for a flexible antenna. A 1.2 cm threaded retainer is soldered at the bottom of rod 44 to enable connection to element 22. The retainer also adds to the overall length of element 22 as previously discussed.

EXAMPLE

A test was performed on nine different antennas, 3 of each embodiment as illustrated in FIGS. 1 and 5, FIGS. 1 and 6 and FIGS. 7 and 8 with the dimensions of the radiating elements as set forth above. Each test antenna was mounted in an upright beacon housing 40 and seated in antenna socket 42 and placed in the center opening of a 8 ft.×8 ft. ground plane. The returnloss was measured using a signal generator, a VSWR bridge and a spectrum analyzer. The radiation efficiency at 121.5 and 243 MHz was tested according to the requirements specified in document RTCA/DO-183. The 406 MHz pattern was tested according to the requirements specified in COSPAT/SARSAT document C/S T.007. TABLE 2 and FIG. 9 set forth measured data for all nine antennas.

It will be understood that the particular embodiments described above are only illustrative of the principles of the present invention, and that various modifications could be made by those skilled in the art without departing from the scope and spirit of the present invention, which is limited only by the claims that follow.

TABLE 1

THIS TABLE PROVIDES INFORMATION ON THE COILS USED FOR ALL TRAPS IN THE THREE STYLES OF SPLIT ANTENNAS

| | TRAP 28 (406 MHz) | TRAP 30 (243 MHz) |
|---|---|---|
| ANTENNA STYLE FIGS. 1 AND 5 | 4 1/2 Turns On 10–32 Screw Thread. (70 nH) Coil Length = 1.0 cm. 9.0 cm. Of Straight Wire, Stripped 0.7 cm. From Each End. The Capacitor Was Mounted Inside The Coil And Both Were Soldered To The Brass Insert Pins. | 10 Turns On 10–32 Screw Thread. (195 nH) Coil Length = 1.0 cm. 16.5 cm. Of Straight Wire, Stripped 0.7 cm. From Each End. The Capacitor Was Mounted Inside The Coil And Both Were Soldered To the Brass Insert Pins. |
| ANTENNA STYLE FIGS. 1 AND 6 | 4 1/2 Turns On 10–32 Screw Thread. (70 nH) Coil Length = 1.0 cm. 9.0 cm. Of Straight Wire, Stripped 0.7 cm. From Each End. The Capacitor Was Mounted Inside The Coil And Both Were Soldered To The Brass Insert Pins. | 10 Turns On 10–32 Screw Thread. (195 nH) Coil Length = 1.0 cm. 16.5 cm. Of Straight Wire, Stripped 0.7 cm. From Each End. The Capacitor Was Mounted Inside The Coil And Both Were Soldered To The Brass Insert Pins. |
| | TRAP 128 (406 MHz) | TRAP 130 (243 MHz) |
| ANTENNA STYLE FIGS. 7 AND 8 | 4 Turns On Unplated Section Of Rod. (70 nH) Coil ID = 0.45 cm. Coil Length = 1.0 cm. 8.0 cm Wire Stripped 0.5 cm. From Each End. The Capacitor Was Mounted On The Outside Of The Coil, Both Were Soldered to Adjacent Elements | 11 1/2 Turns On Unplated Section Of Rod. (195 nH) Coil ID = 0.3 cm. Coil Length = 1.0 cm. 17.0 cm. Wire Stripped 0.5 cm. From Each End The Capacitor Was Mounted On The Outside Of The Coil, Both Were Soldered To Adjacent Elements |

*A COMMON CHIP CAPACITOR VALUE WAS USED FOR ALL TRAPS (2.2 pF)
**#23 AWG VARNISHED WIRE WAS USED FOR ALL COILS (0.06 cm. DIA.)

TABLE 2

Field Measured Antenna Gain And Matching @ 121.5, 243, and 406.025 MHz

Figure 9:
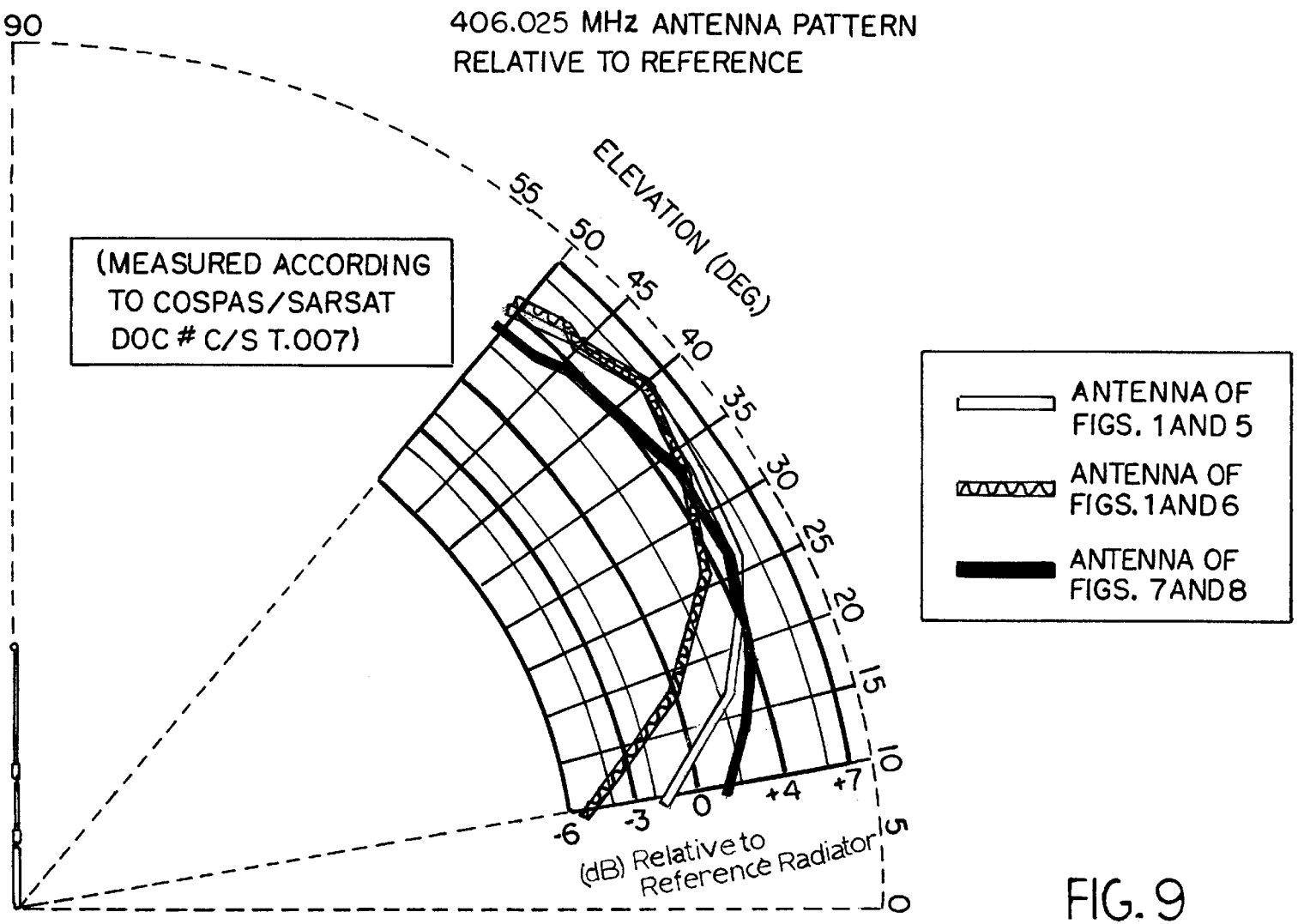
FIG. 9 graphically illustrates the antenna pattern of the present invention at 406 MHz.

| FREQ. | Sample 1 | | Sample 2 | | Sample 3 | |
|---|---|---|---|---|---|---|
| (MHz) | Gain (db) | RL (db) | Gain (db) | RL (db) | Gain (db) | RL (db) |
| ANTENNA STYLE FIGS. 1 AND 5 TRAP OPEN AND UNSHIELDED | | | | | | |
| 406.025 | See FIG. 9 | 15 | See FIG. 9 | 15 | See FIG. 9 | 15 |
| 243 | −1.0 | 27.5 | −1.5 | 28 | −1.5 | 26 |
| 121.5 | −1.9 | 16 | −1.9 | 16 | −1.9 | 16 |
| ANTENNA STYLE FIGS. 1 AND 6 TRAP SHIELDED WITH STAINLESS STEEL TUBE | | | | | | |
| 406.025 | See FIG. 9 | 12 | See FIG. 9 | 13 | See FIG. 9 | 13 |
| 243 | −2.0 | 22 | −2.0 | 24 | −2.0 | 24 |
| 121.5 | −1.7 | 12 | −1.1 | 11 | −1.5 | 10 |
| ANTENNA STYLE FIGS. 7 AND 8-COPPER PLATED FIBREGLASS ROD TRAP UNSHIELDED | | | | | | |
| 406.025 | See FIG. 9 | 12.5 | See FIG. 9 | 13 | See FIG. 9 | 13 |
| 243 | −2.0 | 20 | −1.4 | 19 | −1.5 | 20 |
| 121.5 | −0.8 | 9.5 | −1.2 | 12 | −0.7 | 9 |

What is claimed is:

1. A triple frequency antenna for use as an emergency locator transmitter (EL) comprising;

(a) a first radiating element electrically coupled to said transmitter and to a first band rejection filter;

(b) second radiating element electrically coupled to said first rejection filter and to a second band rejection filter, (c) a third radiating element electrically coupled to said second band rejection filter, wherein said first band rejection filter resonates at a selected resonant frequency and said first radiating element having a length of less than a quarter wavelength at said selected resonant frequency to radiate in a radiation pattern at said selected resonant frequency having an absolute gain in the vertical plane between about −3 dBi to about +4 dBi over the elevation angle from about 10° to about 60°.

2. The antenna of claim 1 where in said first radiating element is combination with the length of a portion of said first band rejection filter forms a length of a quarter wavelength of its radiating frequency.

3. The antenna of claim 1 wherein a single piece radiating rod defines said second and third radiating elements.

4. The antenna of claim 3 wherein said single piece radiating rod is fiberglass that is copper coated and silver plated.

5. The antenna of claim 1 wherein said second and third radiating elements radiate with a gain of no less than −0.7 dBi.

6. The antenna of claim 1 wherein said first radiating element includes a silver plated aluminum outer surface.

7. The antenna of claim 1, further including a housing for housing said transmitter, said housing further houses an impedance matching network for impedance matching said first radiating element at said resonant frequency.

8. The antenna of claim 1, wherein said first band rejection filter is around 1.0 cm in length.

9. The antenna of claim 8, wherein said first band reaction filter is encased in a hardened housing.

10. The antenna of claim 1, further comprising a floatable aid transmitter.

11. The antenna of claim 1, wherein said first band rejection filter includes an inductor of about 70 nH in parallel with a capacitor of about 2.2 pF.

12. The antenna of claim 1, wherein said first radiating element and characteristics of said first band rejection filter are such as to obtain a beam peak pointing at an elevation angle in the range of 20° to 40°.

13. The antenna of claim 12, wherein said beam peak points at an about 30°.

14. The antenna of claim 1, wherein said radiation pattern is substantially symmetric about its beam peak over at least about +/−10° from its beam peak.

15. The antenna of claim 1, wherein said first band rejection filter comprises a 70 nH inductor, a coil length of about 1 cm, with about 4 turns, and a chip capacitor of about 2.2 pF in parallel with the coil.

16. A monopole triple frequency antenna for use as an emergency locator transmitter (ELT) for simulataneous transmission of about 121.5, 243 and 406 MHz emergency signals comprising:

(a) a first radiating element electrically coupled to said transmitter and to a first band rejection filter;

(b) a second radiating element electrically coupled to said first band rejection filter and to a second band rejection filter;

(c) a third radiating element electrically coupled to said second band rejection filter;

wherein said first band rejection filter resonates at a resonant frequency of about 406 MHZ and said first radiating element coupled to said first band rejection filter radiates in a radiation pattern having an absolute gain in the vertical plane between about −3 dBi to about +4 dBi over the elevation angle from about 10° to about 60° at said resonant frequency of about 406 MHz; wherein said first radiating element has a length of less than a quarter wavelength at said resonant frequency at about 406 MHz, and second band rejection filter is tuned so that said first and second radiating elements in combination with said first band rejection filter radiate at about 243 MHz, and said first, second and third radiating elements radiate at about 121.5 MHz.

17. The antenna of claim 16 wherein said second and third radiating elements radiate with a gain of no less than −0.7 dBi.

18. A triple frequency antenna for use as an emergency locator transmitter (ELT) comprising:

(a) a first radiating element electrically coupled to said transmitter and to a first band rejection filter;

(b) a second radiating element electrically coupled to said first band rejection filter and to a second band rejection filter;

(c) a third radiating element electrically coupled to said band rejection filter;

wherein said first band rejection filter is selected to resonate at a resonant frequency in the ultra high-frequency (UHF) band and said first radiating element having a length of less than a quarter wavelength at said resonant frequency to obtain a radiation pattern at said resonant frequency having a beam peak pointing about 30° from a horizontal plane normal to the antenna and with a radiation pattern substantially symmetric about its beam peak over at least about +/−10° from the beam peak.

* * * * *